US010436079B2

(12) United States Patent
Pham

(10) Patent No.: US 10,436,079 B2
(45) Date of Patent: Oct. 8, 2019

(54) VARIABLE VALVE DRIVE HAVING A ROCKER LEVER

(71) Applicant: MAN Truck & Bus AG, München (DE)

(72) Inventor: Hai-Son Pham, Nürnberg (DE)

(73) Assignee: MAN TRUCK & BUS AG, München (DE)

( * ) Notice: Subject to any disclaimer, the term of this patent is extended or adjusted under 35 U.S.C. 154(b) by 51 days.

(21) Appl. No.: 15/359,200

(22) Filed: Nov. 22, 2016

(65) Prior Publication Data

US 2017/0152769 A1 Jun. 1, 2017

(30) Foreign Application Priority Data

Nov. 26, 2015 (DE) ..... 10 2015 015 264

(51) Int. Cl.
*F01L 1/34* (2006.01)
*F01L 13/00* (2006.01)
(Continued)

(52) U.S. Cl.
CPC ..... *F01L 13/0021* (2013.01); *F01L 1/08* (2013.01); *F01L 1/18* (2013.01); *F01L 1/181* (2013.01); *F01L 1/20* (2013.01); *F01L 1/24* (2013.01); *F01L 13/00* (2013.01); *F01L 13/0005* (2013.01); *F01L 13/0063* (2013.01); *F01L 2001/186* (2013.01); *F01L 2013/0068* (2013.01)

(58) Field of Classification Search
CPC .. F01L 13/0021; F01L 1/181; F01L 2001/186
See application file for complete search history.

(56) References Cited

U.S. PATENT DOCUMENTS 5,564,385 A * 10/1996 Hakansson ..... F01L 1/2411 123/321
2004/0231625 A1 11/2004 Sugiura et al.
(Continued)

FOREIGN PATENT DOCUMENTS

DE 4230877 A1 4/1993
DE 19519048 A1 11/1996
(Continued)

OTHER PUBLICATIONS

European Search Report issued in corresponding application No. 16002316.4 dated Mar. 27, 2017.

*Primary Examiner* — Zelalem Eshete
(74) *Attorney, Agent, or Firm* — Weber Rosselli & Cannon LLP

(57) ABSTRACT

A variable valve drive for a lifting valve, such as a charge-exchange valve of an internal combustion engine, that is periodically movable between closed and open positions indirectly by way of a cam via a rocker lever. The variable valve drive includes a switchable rocker lever arrangement for the actuation of the lifting valve, having a transmission rocker lever and a valve rocker lever which are mounted pivotably on different rocker lever axles parallel to the camshaft axis. The valve rocker lever, is in operative contact with the lifting valve at a first end, and has a roller, at a second end. The transmission rocker lever, is in engagement with a cam of the camshaft and, is operatively connected to the roller of the valve rocker lever.

16 Claims, 8 Drawing Sheets

1

(51) Int. Cl.

| | |
|---|---|
| ***F01L 1/08*** | (2006.01) |
| ***F01L 1/18*** | (2006.01) |
| ***F01L 1/20*** | (2006.01) |
| ***F01L 1/24*** | (2006.01) |

(56) References Cited

U.S. PATENT DOCUMENTS

| | | | | |
|---|---|---|---|---|
| 2006/0075982 | A1* | 4/2006 | Fujita | F01L 1/08<br>123/90.16 |
| 2007/0125330 | A1 | 6/2007 | Lee et al. | |
| 2007/0137614 | A1 | 6/2007 | Tsuzuki | |
| 2009/0151665 | A1 | 6/2009 | Park | |

FOREIGN PATENT DOCUMENTS

| | | | |
|---|---|---|---|
| DE | 19520117 | C2 | 4/2002 |
| DE | 10227870 | A1 | 1/2004 |
| EP | 0717174 | A1 | 6/1996 |

* cited by examiner

VARIABLE VALVE DRIVE HAVING A ROCKER LEVER

BACKGROUND OF THE DISCLOSURE

The present disclosure relates to a variable valve drive for a lifting valve, in particular for a charge exchange valve of an internal combustion engine, which is periodically movable between a closed position and an open position indirectly by a cam via a rocker lever.

It is known for gas exchange valves of an internal combustion engine to be operated in a variable manner with different opening and closing times and with different valve opening lifts. Such variable valve drives offer the advantageous possibility of targeted adaptation of the profile of the valve lift curve over the cam angle as a function of operating parameters of the device that is equipped with the respective lifting valve, that is to say for example as a function of rotational speed, load or temperature of an internal combustion engine.

In particular, it is known for multiple different lift curves for a lift valve to be generated by virtue of multiple cams being provided for the actuation of said lifting valve, and by virtue of the fact that, in each case, the contour of only one cam acts on the lifting profile. For the switch to another lifting profile, a switch is made to the contour of another cam. Such valve control is already known from DE 42 30 877 A1. Here, a camshaft block with two different cam contours is arranged rotationally conjointly but axially displaceably on a camshaft. In accordance with the axial position of the cam block, a cam contour is operatively connected to the lifting valve via an intermediate element (transmission lever). The axial displacement of the cam block for the purposes of varying the valve parameters is performed, during the base circle phase, by way of a thrust ring counter to the action of a restoring spring.

DE 195 19 048 A1 has already disclosed a variable valve drive for an internal combustion engine, in which it is likewise the case that two cams which are of different design in terms of their cam contour are arranged directly adjacent to one another on the camshaft. The change of the cam engagement is realized by way of an axial displacement of the camshaft with the cams situated thereon.

Furthermore, DE 195 20 117 C2 has already disclosed a valve drive of an internal combustion engine, in the case of which an axially displaceable cam block with at least two different cam tracks is arranged rotationally conjointly on the camshaft. The adjustment of the cam block is realized by way of an adjustment member which is guided in the interior of the camshaft. By way of a double-acting hydraulic or pneumatic piston-cylinder unit arranged at the face side on the camshaft, the adjustment member is displaced in the interior of the camshaft. The adjustment member is connected to a driver piece which extends through an elongated hole arranged in the camshaft and which issues into a bore of the cam block.

A disadvantage of the cited prior art is that different opening and closing times and different valve opening lifts cannot be set in continuously variable fashion. A further disadvantage is that, with said known approaches, it is not possible for an existing valve drive without variability to be converted to a valve drive with variability without the need for changes to be made to peripheral components aside from those directly required for realizing the variability.

SUMMARY

It is an object of the present disclosure to provide an improved variable valve drive having a rocker lever, by way of which disadvantages of conventional techniques can be avoided. It is the object of the present disclosure in particular to provide a variable valve drive which permits a continuous variation of the valve opening and closing times and of the valve opening lifts.

Said objects are achieved by way of a variable valve drive having the features of the independent claim. Advantageous embodiments and uses of the present disclosure are defined in the dependent claims and will be discussed in more detail in the following description, in part with reference to the figures.

According to the present disclosure, a variable valve drive for a lifting valve is provided. The lifting valve is periodically movable between a closed position and an open position, in particular counter to the force of a restoring spring, indirectly by way of a cam of a camshaft. The lifting valve may be a charge exchange valve of an internal combustion engine.

According to general aspects of the present disclosure, the valve drive comprises a switchable rocker lever arrangement for the actuation of the lifting valve. A switchable rocker lever arrangement is to be understood to mean a rocker lever arrangement which, by way of a switching device or actuating device, can be varied in terms of its transmission characteristics, with regard to the transmission of the cam movement to the lifting valve, in such a way that a valve opening and/or closing time and/or a magnitude of the valve opening lift can be varied.

The rocker lever arrangement comprises a first rocker lever, hereinafter referred to as transmission rocker lever, and a second rocker lever, hereinafter referred to as valve rocker lever, which are mounted pivotably on different rocker lever axles which are each parallel to the camshaft axis. Here, the valve rocker lever, at a first end, is in operative contact with the lifting valve, and at a second end, has a roller, in particular a thrust roller. The transmission rocker lever is assigned, at a first end, to a cam of the camshaft, that is to say engages with the cam in order to pick off the cam movement. The transmission lever performs a rocking movement in accordance with the cam movement. At a second end, the transmission rocker lever is operatively connected by way of a contour surface, in particular a valve-lift-defining contour surface, to the roller of the valve rocker lever, in such a way that a rocking movement of the transmission rocker lever generates a corresponding rocking movement of the valve rocker lever, in the case of which the roller of the valve rocker lever rolls on the contour surface. As a result of the rocking movement of the transmission lever, the roller of the rocker lever thus rolls on the contour surface, and the resulting rocking movement of the valve rocker lever gives rise to a corresponding valve lift. In this context, the transmission lever and valve lever are connected in series.

The contour surface is a surface of the transmission rocker lever on which the roller of the valve rocker lever rolls back and forth during the transmission of the cam movement to the lifting valve and thus transmits or couples the movement of the transmission rocker lever to the valve rocker lever. The profile of the valve lift can be defined by way of the design of the surface shape of the contour surface, for example of the gradient in a rolling direction.

The variable valve drive comprises an actuating device for the switching of the rocker lever arrangement, by way of which actuating device the contour surface can be rotated about the rocker lever axle of the transmission rocker lever in order to generate a displacement of a rolling region of the roller of the valve rocker lever on the contour surface. The actuating device is designed to generate a rotation of the contour surface, or of that part of the transmission rocker lever which comprises the contour surface, relative to the valve rocker lever. In this way, that region of the contour surface which is picked off by the roller of the valve rocker lever, and thus also the resulting valve lift and/or the valve opening and/or closing times, are varied.

An advantage of the variable valve drive according to the present disclosure is that the construction of the rocker lever and camshaft can remain unchanged—in relation to a conventional, non-variable valve drive. A further advantage is that the variable valve drive performs the valve actuation with few moving masses, because the valve rocker lever rocks upward and downward in the conventional manner, the transmission rocker lever likewise rocks upward and downward, and the camshaft rotates in the conventional manner. Furthermore, the variable valve drive makes it possible to realize a highly robust solution for fully variable control, in particular for the sector of utility vehicle engines and industrial engines.

In a one embodiment, the contour surface has a first rolling region which generates no valve lift when the roller of the valve rocker lever rolls on the first rolling region. The first rolling region forms in particular a base circle contour, and will hereinafter also be referred to as base circle region. The rolling points on the base circle region may have a constant radial spacing to the axis of the rocker lever axle of the transmission lever.

In a second embodiment, the contour surface furthermore has a second rolling region which adjoins the first rolling region and which has a ramp contour. A ramp contour defines a valve lift in such a way that the valve lift becomes greater the further the roller of the valve rocker lever rolls on the second rolling region proceeding from the first rolling region. A ramp contour is thus to be understood in particular to mean a region which, in a direction of movement of the roller, has an increasing radial spacing to the axis of the rocker lever axle of the transmission lever. In the opposite movement direction of the roller, the radial spacing to the second rolling region consequently decreases.

A rolling region is to be understood to mean a region of the contour surface on which the roller of the valve rocker lever can roll during a rocking movement of the transmission rocker lever. The extent to which the roller actually rolls on a particular rolling region during a rocking movement is dependent on the rotational position, set by the actuating device, of the contour surface.

In an advantageous variant of said embodiment, the contour surface has a third rolling region which adjoins the second rolling region. The third rolling region may generate a valve position with a predetermined constant valve lift, for example a valve position with maximum valve lift, when the roller of the valve rocker lever rolls on the third rolling region. The rolling points on the third rolling region probably have a constant radial spacing to the axis of the rocker lever axle of the transmission lever. The radial spacing of the third rolling region is however greater than that of the first rolling region.

The region of the contour surface rolled on by the rocker lever roller always remains constant in terms of angular magnitude. As a result of the rotation of the contour surface relative to the valve rocker lever by way of the actuating device, however, that region of the contour surface which is actually picked off, that is to say rolled on, by the roller can be displaced. For example, if the contour surface is rotated relative to the valve rocker lever by way of the actuating device such that the rocker lever rolls over a shorter distance on the first region and, instead, over a greater distance on the second region, the valve lift is increased. The valve lift and/or the valve opening and closing times that result from the rolling of the valve rocker lever on the contour surface can be set by way of expedient configuration of the dimensions and/or gradients and/or gradient profiles of the rolling regions. Depending on the setting or variation of the rolling region, the lifting valve can for example be held fully closed, for example if the roller of the valve rocker lever rolls back and forth exclusively on the first rolling region. Furthermore, it is possible to realize valve operation in which the lifting valve is briefly held open at maximum valve lift. This may be achieved for example if the contour surface is, by way of the actuating device, fixed in a rotational position in which the rolling movement of the roller of the valve rocker lever also at least partially encompasses the third region. During the rolling movement on the third region, the lifting valve is briefly held open at maximum valve lift.

In a further advantageous variant of this embodiment, the contour surface has a fourth rolling region, which adjoins the third rolling region and which in turn forms a ramp contour, and a fifth region, which adjoins the fourth rolling region. The rolling points on the fifth rolling region have a constant radial spacing to the axis of the rocker lever axle of the transmission lever. The radial spacing of the rolling region is greater than the radial spacing of the third rolling region and greater than the radial spacing of the first rolling region. In this design variant with five rolling regions, the third region forms a middle position, in which, briefly, that is to say when the roller rolls on the third region, the lifting valve is held open in an open position with a constant lift magnitude which is smaller than the maximum lift magnitude.

In a further embodiment, the transmission rocker lever comprises a first lever, which is in engagement with the cam of the camshaft, and a second lever, having the contour surface which is in operative connection with the roller of the valve rocker lever. The first lever and the second lever are coupled to one another in terms of movement, in particular in such a way that a rocking movement of the first lever generated by the cam leads to a corresponding rocking movement, with the same angular magnitude, of the second lever about the rocker lever axle of the transmission rocker lever. Furthermore, by way of the actuating device, a rotational position of the second lever relative to the first lever can be varied in order to vary a rolling region of the roller of the valve rocker lever on the contour surface. In the rotational position that can be set by way of the actuating device, the first lever and the second lever are then coupled to one another in terms of movement again such that, when caused to do so by the cam, they are pivoted back and forth jointly about the rocker lever axle. In this way, it is possible for a robust adjustable transmission mechanism for the variable transmission of the cam movement to the valve rocker lever to be provided.

It is particularly advantageous if the actuating device is designed to vary a rotational position of the second lever relative to the first lever in continuous fashion. Alternatively, the actuating device may be designed to vary a rotational position of the second lever relative to the first lever into two or more predetermined positions, such that switching is possible between two or more different rolling regions on the contour surface, and thus valve lifts.

One advantageous option of the realization according to the present disclosure provides that the actuating device is designed as a hydraulic switching unit. For example, the actuating device may have a hydraulically actuable and/or actuated switching pin which, at its first end, is fastened to the first lever and, at a second end, is fastened to the second lever of the transmission rocker lever, wherein a deployment of the switching pin varies a rotational position of the second lever relative to the first lever.

Alternatively, the actuating device may be designed as an electrical and/or mechanical actuating device, for example for the electrical and/or mechanical actuation of the switching pin.

Furthermore, the first lever and the second lever may be coupled to one another by way of a driver. The driver may furthermore form a receptacle for the switching pin and thus perform a dual function.

In a further embodiment, the transmission rocker lever may be preloaded by way of a restoring spring such that the transmission lever is pushed against the camshaft. This makes it possible for the cam movement to be picked off in a reliable manner. For example, the first lever of the transmission lever may be preloaded by way of a restoring spring such that the transmission lever is pushed against the camshaft.

In the context of the present disclosure, it is also possible for the valve rocker lever, at its valve-side end, to have a receptacle in which there is received a hydraulic valve-clearance compensating element or a screw with an elephant-foot configuration.

The rocker lever may furthermore, on its underside, that is to say on its side facing toward the cylinder head, have a geometry for axial fixing to a bearing block. For example, the rocker lever may have a bearing arrangement for fastening to a rocker lever bearing block on which the rocker lever axle is arranged, onto which rocker lever axle the rocker lever is, by way of an associated bore, pivotably mounted and held by way of an axial position-securing means, wherein the axial position-securing means is a guidance-imparting connection, as an engagement element-counterpart element connection, between the bearing block and the rocker lever, in the case of which an engagement element oriented transversely with respect to the axial direction, for example in the form of a ring-shaped web, engages pivotably into an associated counterpart element with axial flank support.

A further aspect of the present disclosure relates to a motor vehicle, in particular a utility vehicle, having a variable valve drive as described in this document.

The above-described embodiments and features of the present disclosure may be combined with one another as desired. Further details and advantages of the present disclosure will be described below with reference to the appended drawings, in which:

BRIEF DESCRIPTION OF THE FIGURES

Identical parts are denoted by the same reference designations in the figures, such that the various views of the valve drive shown in the figures can be understood from this also.

DESCRIPTION

Figure 1:
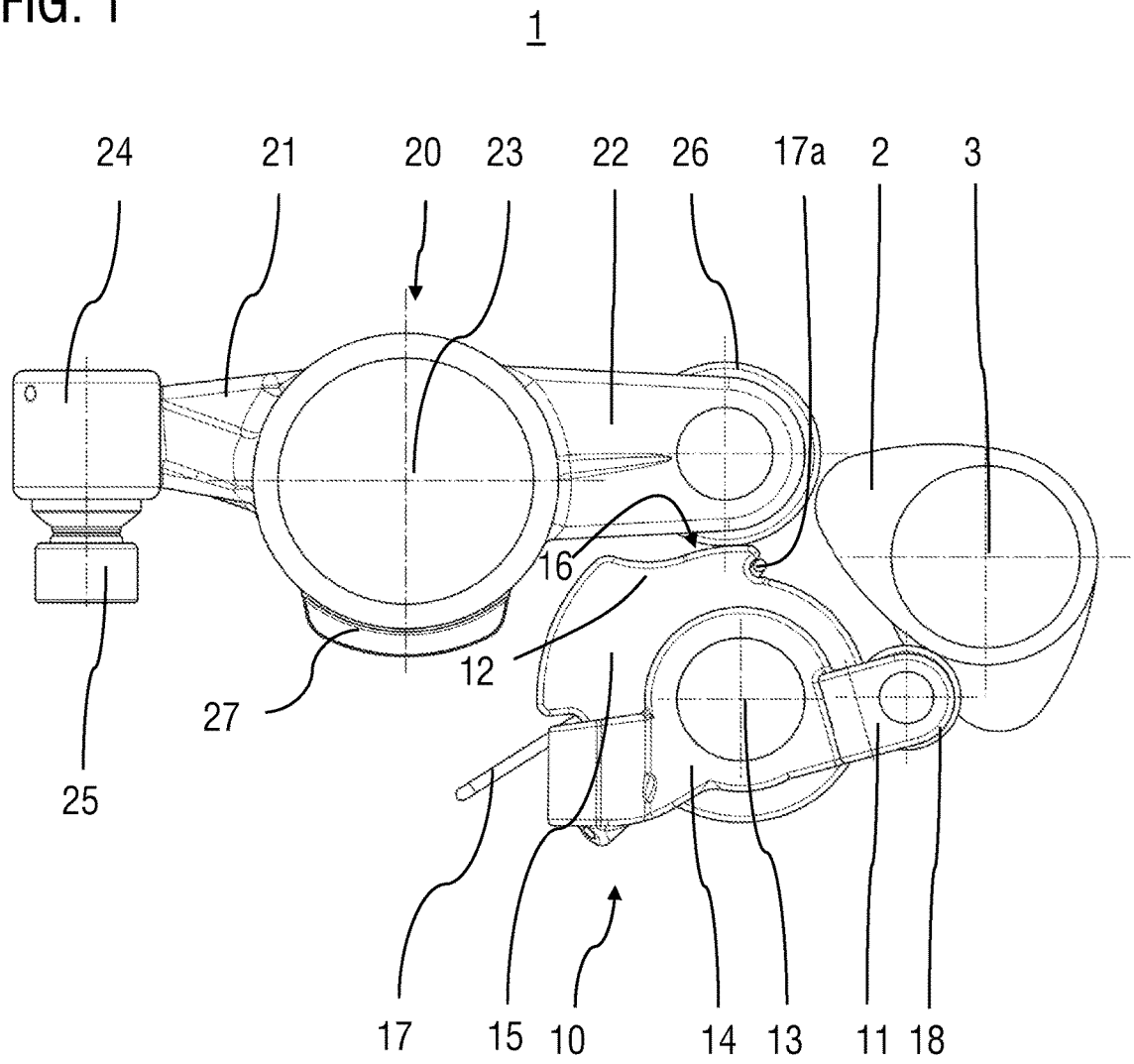
FIG. 1 shows a side view of a valve drive according to an embodiment of the present disclosure.
Figure 2:
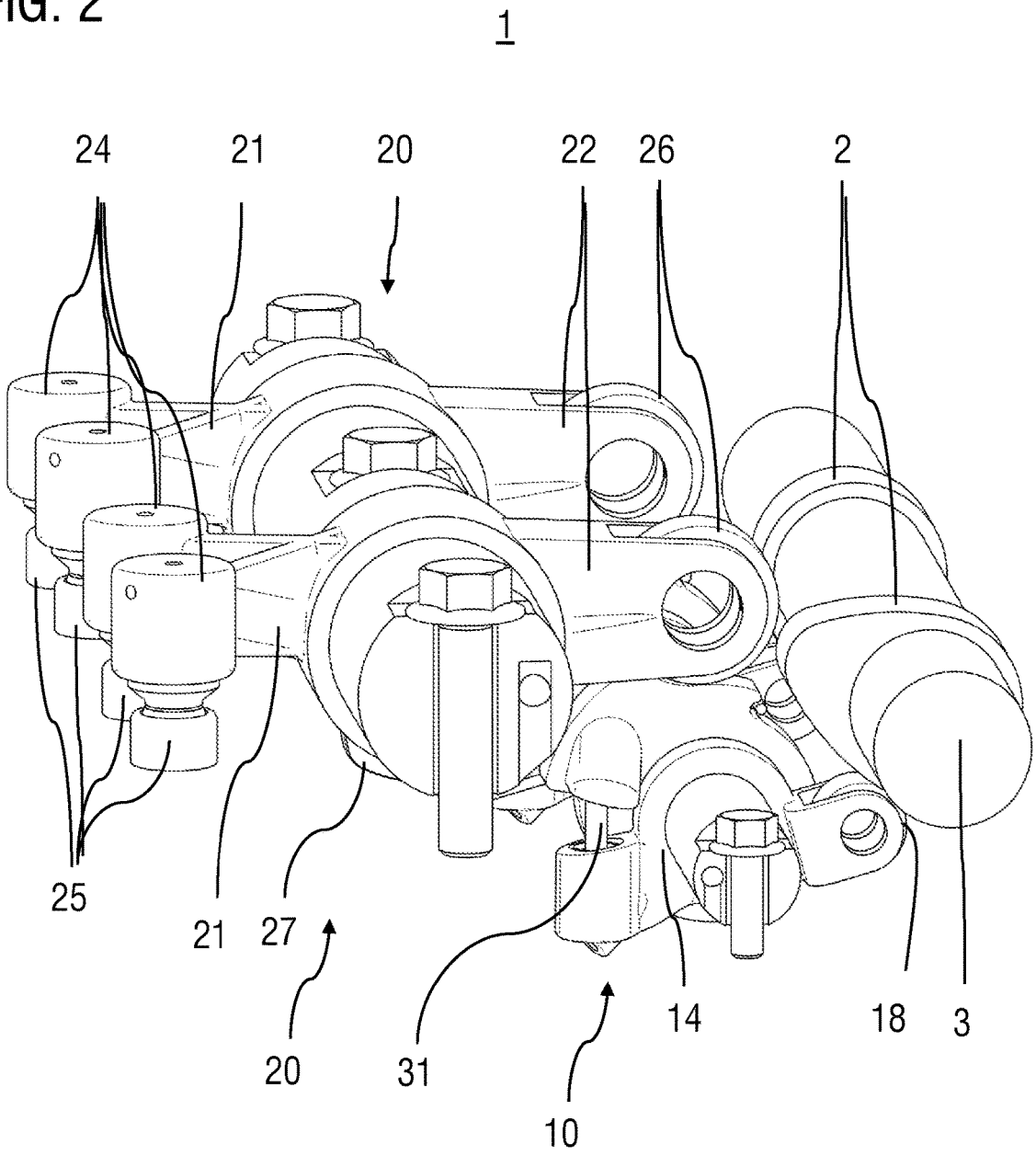
FIG. 2 shows a perspective side view of a valve drive according to an embodiment of the present disclosure.

FIGS. 1 and 2 show a side view and a perspective side view, respectively, of a variable valve drive 1 according to an embodiment of the present disclosure. The valve drive 1 serves for the actuation of charge exchange valves (not shown) of an internal combustion engine, which charge exchange valves are periodically movable between a closed position and an open position indirectly by way of a cam 2 of a camshaft 3.

The valve drive 1 comprises a switchable rocker lever arrangement for the actuation of the lifting valves. The rocker lever arrangement comprises a first rocker lever (valve rocker lever) 20, which is mounted so as to be pivotable about a rocker lever axle 23, and a second rocker lever (transmission rocker lever) 10, which is mounted so as to be pivotable about a further rocker lever axle 13. The two rocker lever axles 13, 23 are spatially separate but are both parallel to the axis of the camshafts 3.

The valve rocker lever 20 is, at a valve-side end 21, that is to say by way of its valve-side lever arm 21, in operative contact with two lifting valves (not shown). The valve-side lever arm 21 of the valve rocker lever 20 is, for this purpose, designed as a two-valve lever arm for the purposes of actuating two charge exchange valves simultaneously. For this purpose, the valve-side lever arm 21 is of forked form, as can be seen in FIG. 2. As can also be seen in FIG. 2, two such valve rocker lever arrangements 10, 20 are arranged one behind the other in an axial direction of the camshaft for the purposes of actuating four lifting valves. A receptacle 24 is arranged at each valve-side end of the lever arm 21. The receptacle 24 may be used for the mounting of a hydraulic valve-clearance compensating element 25 such as is known per se. Instead of a hydraulic valve-clearance compensating element, it is also possible, with corresponding machining, for there to be received in the receptacle 24 a screw with an elephant-foot configuration, by way of which a valve clearance can be manually readjusted.

Hydraulic valve-clearance compensating elements in internal combustion engines are known per se and serve for compensating in particular the changes in length dimensions of the charge exchange valves over the service life, in such a way that reliable valve closure is ensured in the base circle phase of the cam that actuates the valve. Here, it is on the other hand sought for the cam lift to be transmitted to the valve, and thus converted into a valve lifting movement, without losses. The mode of operation of such hydraulic valve-clearance compensating elements which are arranged in the force flow of a valve controller, in particular of an internal combustion engine, is assumed to be known.

The valve rocker lever 20 is held on a rocker lever bearing block (not shown), wherein the rocker lever axle 23 is arranged on the rocker lever bearing block, onto which rocker lever axle the valve rocker lever 20 is, by way of an associated bore, pivotably mounted and held by way of an axial position-securing means. In the present exemplary embodiment, the axial position-securing means is designed as an engagement element-counterpart element connection between the bearing block and the rocker lever, in the case of which an engagement element oriented transversely with respect to the axial direction, for example in the form of a ring-shaped web 27, engages pivotably into an associated counterpart element (not illustrated) with axial flank support. The axial position-securing means may however also be realized, in a manner known per se, by way of abutment surfaces on the rocker lever flanks. Said flanks may be created for example by calibration of the forged blank or by mechanical machining. At the bearing block side, the fixing may likewise be realized by way of correspondingly machined surfaces and by way of discs and securing rings. Furthermore, axial position-securing means between a rocker lever and the axle are known. For example, for this purpose, a region of the axle which is surrounded by the bore of the rocker lever has a ring-shaped groove in which there runs a circlip, which simultaneously runs by way of its outer ring-shaped section in a ring-shaped groove of the rocker lever.

At its opposite end 22 in relation to the rocker axle 23, that is to say at the camshaft-side lever arm 22, a roller 26 is arranged on the distal end of the lever arm 22.

The transmission rocker lever 10 is in engagement, at a camshaft-side end 11, with the cam 2 of the camshaft 3. For this purpose, a roller 18, for example a thrust roller, is arranged on the camshaft-side end 11, which roller rolls on the cam 2 of the camshaft 3 and thus picks off the cam movement. The transmission rocker lever 10 is furthermore, at the other end 12 in relation to the rocker lever axle 13, operatively connected by way of a lift-defining surface, referred to as contour surface 16, to the roller 26 of the valve rocker lever 20, that is to say the roller 26 of the valve rocker lever 20 rolls on the contour surface 16 during a rocking movement of the transmission rocker lever 10 generated by the cam movement, whereby a corresponding rocking movement of the valve rocker lever 20 is generated. The transmission rocker lever 10, by way of its rocking movement, transmits the cam movement to the valve rocker lever 20, which in turn, by way of its correspondingly resulting rocking movement, generates the valve lift. In this way, the transmission rocker lever 10 and valve rocker lever 20 are connected in series. The camshaft 3 and valve rocker lever 20 may, for this purpose, be designed in a manner known per se, and are coupled to one another in terms of movement by way of the transmission lever 10 arranged in between.

The contour surface 16 on which the valve rocker lever roller 26 is supported serves as a rolling region on which the valve rocker lever roller 26 rolls back and forth during the transmission of the rocking movement of the transmission rocker lever 10 to the valve rocker lever 20. The lift characteristic of the lifting valve can thus be predefined, and also varied, by way of the design of said contour surface 16 which serves as rolling surface.

Figure 3:
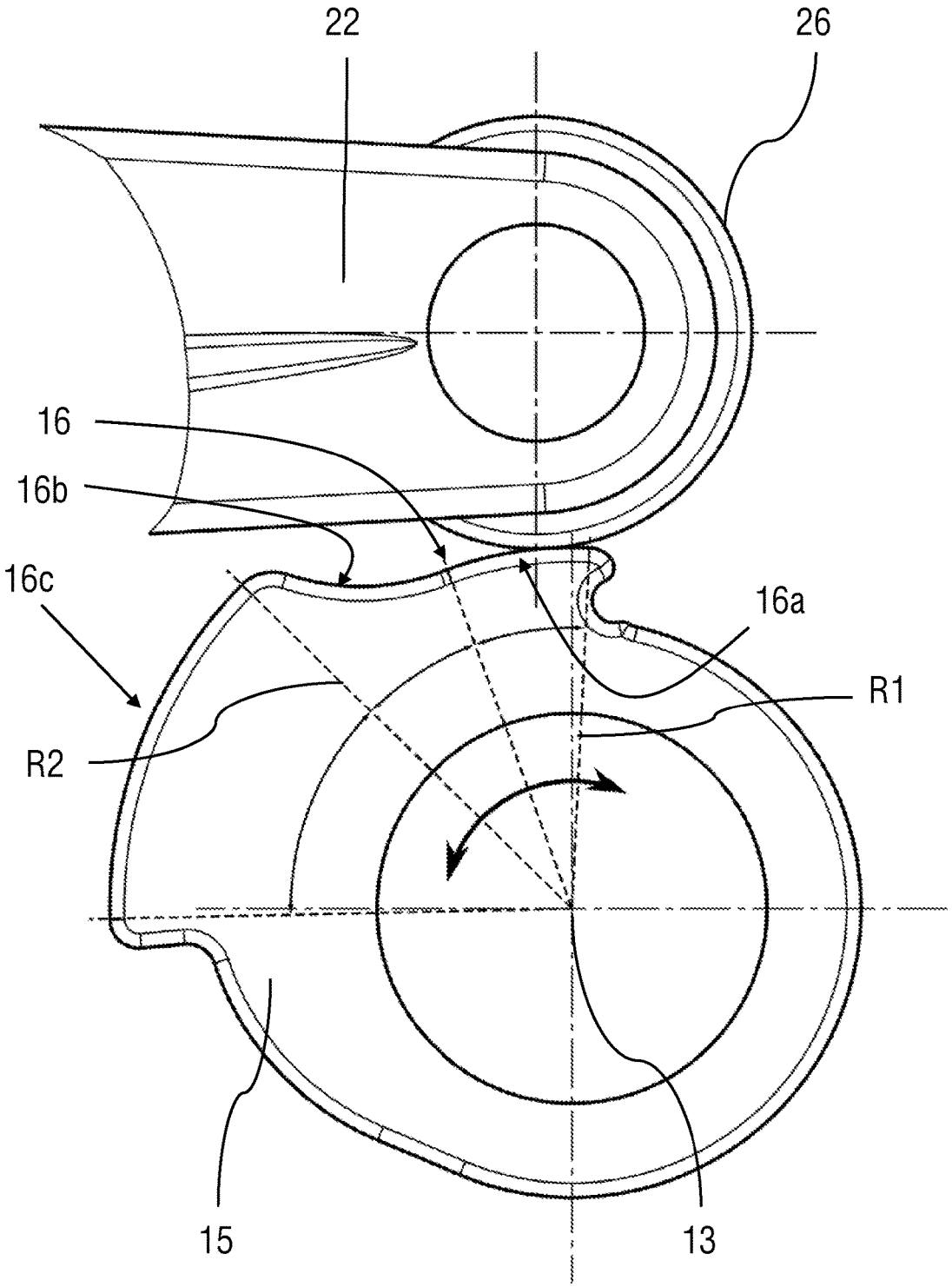
FIG. 3 shows a detail view of the coupling between valve rocker lever and transmission rocker lever according to an embodiment of the present disclosure.

FIG. 3 shows a detail view of the coupling between valve rocker lever 20 and the transmission rocker lever 10 at the contour surface 16. In this exemplary embodiment, the contour surface 16 has three different regions 16*a*, 16*b* and 16*c*, which can serve as rolling regions for the roller 26.

The first rolling region 16*a* forms the base circle contour, that is to say the valve rocker lever 20 generates no valve lift when the roller 26 rolls on said region. The spacing of the points on the first rolling surface 16*a* to the axis of the rocker lever axle 13, that is to say the radial spacing R1 thereof, is constant. The contour surface 16 furthermore comprises a second rolling region 16*b* which directly adjoins the first rolling region 16*a* and which has a ramp contour. On the second rolling region, the radial spacing of the rolling points increases from a value R1 to a value R2. Thus, if the roller 26 rolls on the second region 16*b* proceeding from the first region 16*a*, the valve rocker lever 20 rocks more the further the roller 26 rolls on the second rolling region 16*b*. Consequently, the valve lift that is generated is greater the further the roller 26 of the valve rocker lever 20 rolls on the second rolling region 16*b* proceeding from the first rolling region 16*a*.

The second rolling region 16*b* is adjoined by a third rolling region 16*c*, which has a constant radial spacing R2 and which generates a valve position with maximum valve lift if the roller 26 of the valve rocker lever 20 rolls on the third rolling region 16*c*.

The valve drive 1 furthermore comprises an actuating device 30 for the switching of the rocker lever arrangement 10, 20, by way of which actuating device the contour surface 16 can be rotated about the rocker lever axle 13 of the transmission rocker lever 10 in order to generate a displacement of a rolling region of the roller 26 of the valve rocker lever 20 on the contour surface 16. In this way, that region of the contour surface 16 which is rolled on, that is to say picked off, by the roller of the valve rocker lever is varied, along with the resulting valve lift and/or the valve opening and/or closing times.

For this purpose, the embodiment of the transmission rocker lever 10 shown in FIG. 1 comprises a first lever 14, hereinafter also referred to as cam follower lever, which is in engagement, by way of a roller 18, with the cam 2 of the camshaft 3. The transmission rocker lever 10 furthermore comprises a second lever 15, hereinafter referred to as contour lever, which has the contour surface 16 which is operatively connected to the roller 26 of the valve rocker lever 20.

The cam follower lever 14 and the contour lever 15 are coupled to one another in terms of movement, in such a way that a rocking movement of the cam follower lever 14 generated by the cam 2 leads to a corresponding rocking movement of the contour lever 15 about the rocker lever axle 13 of the transmission rocker lever 10. By way of an actuating device 30, however, a rotational position of the contour lever 15 relative to the cam follower lever 14 can be varied in order to vary a rolling region of the roller 26 of the valve rocker lever 20 on the contour surface. In each of the different settable rotational positions, the cam follower lever 14 and contour lever 15 are then again coupled in terms of movement with regard to a pivoting movement (rocking movement) about the rocker lever axle 13.

Figure 4:
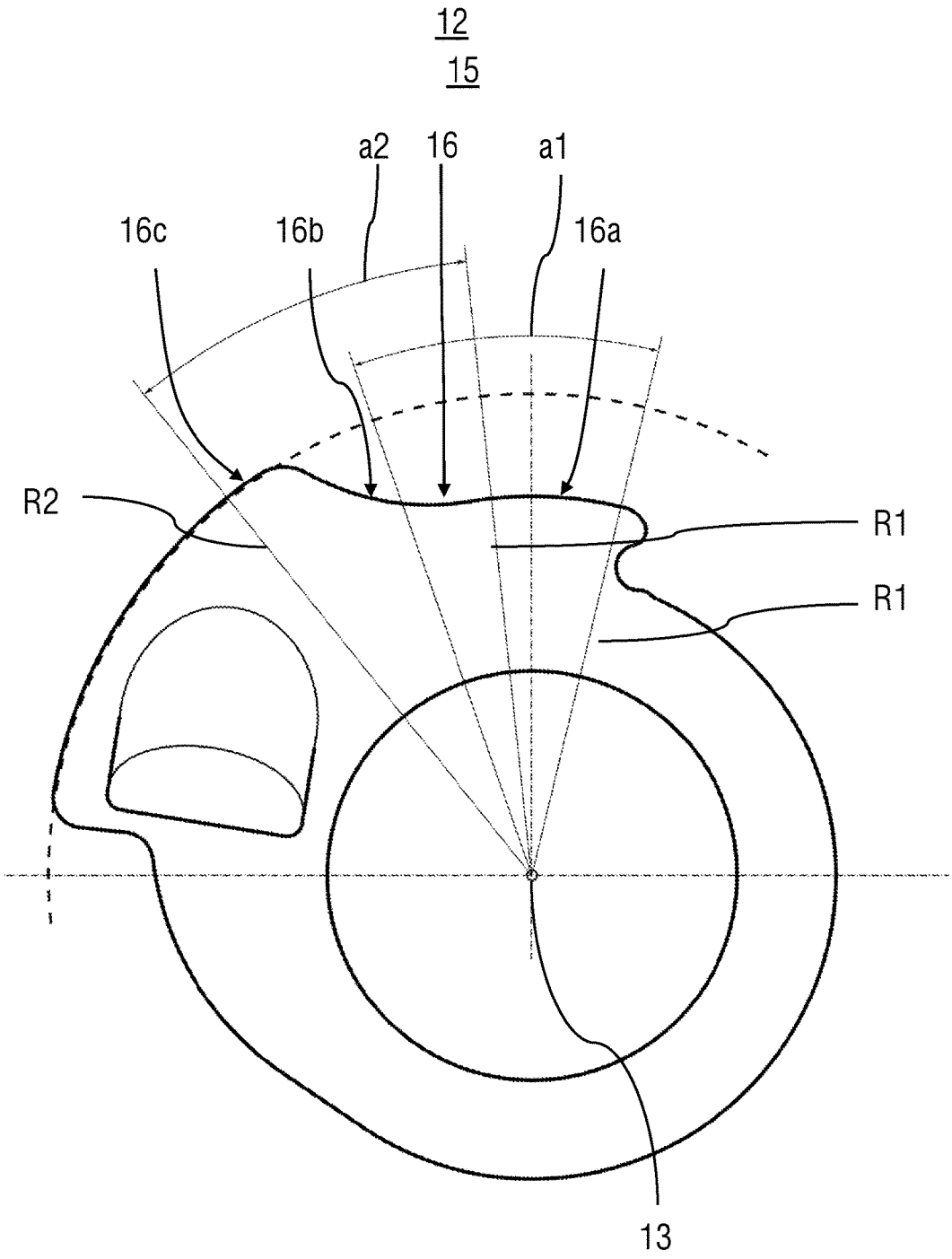
FIG. 4 shows a side view of a second lever of the transmission rocker lever according to an embodiment of the present disclosure.

The different settable rolling regions are illustrated in FIG. 4. FIG. 4 shows a side view of the contour lever 15 of the transmission rocker lever 10 according to an embodiment of the present disclosure.

For example, the actuating device, which is discussed in more detail below on the basis of FIGS. 7 and 8, may be designed to set to different rotational positions of the contour lever 15 relative to the cam follower lever 14, resulting in two different rolling regions a1 and a2 for the roller 26 of the valve rocker lever 10.

In a first set rotational position, during a rocking movement of the transmission rocker lever 10 or of the contour lever 15 generated by the cam 2, the roller 26 rolls back and forth on the first rolling region a1, which encompasses almost the entire first rolling region 16*a* and a first subregion of the second rolling region 16*b*. By contrast, in a second set rotational position, during a rocking movement of the transmission rocker lever 10 or of the contour lever 15 generated by the cam 2, the roller 26 rolls back and forth on the second rolling region a2, which encompasses almost the entire second rolling region 16*b* and a subregion of the third rolling region 16*c*.

If the valve drive 1 is switched from the rolling region a1 to the rolling region a2, the valve lift that can be generated by the camshaft 3 is increased. As can be seen in FIG. 4, the radial spacing at the right-hand end region of the region a2 is still equal to the radial spacing in the first rolling region 16*a*, such that, at this location, a closed position of the lifting valves is generated.

The actuating device may be designed such that it can set a rotational position of the second lever relative to the first lever into two predetermined positions, such that switching is possible between two different, predetermined rolling regions on the contour surface 16, and thus valve lifts. Alternatively, the actuating device may also be designed such that more than two predetermined rotational positions can be set, or the rotational position is continuously variable within predefined limits. In the latter variant, the valve lift can be varied in continuous fashion.

Figure 5:
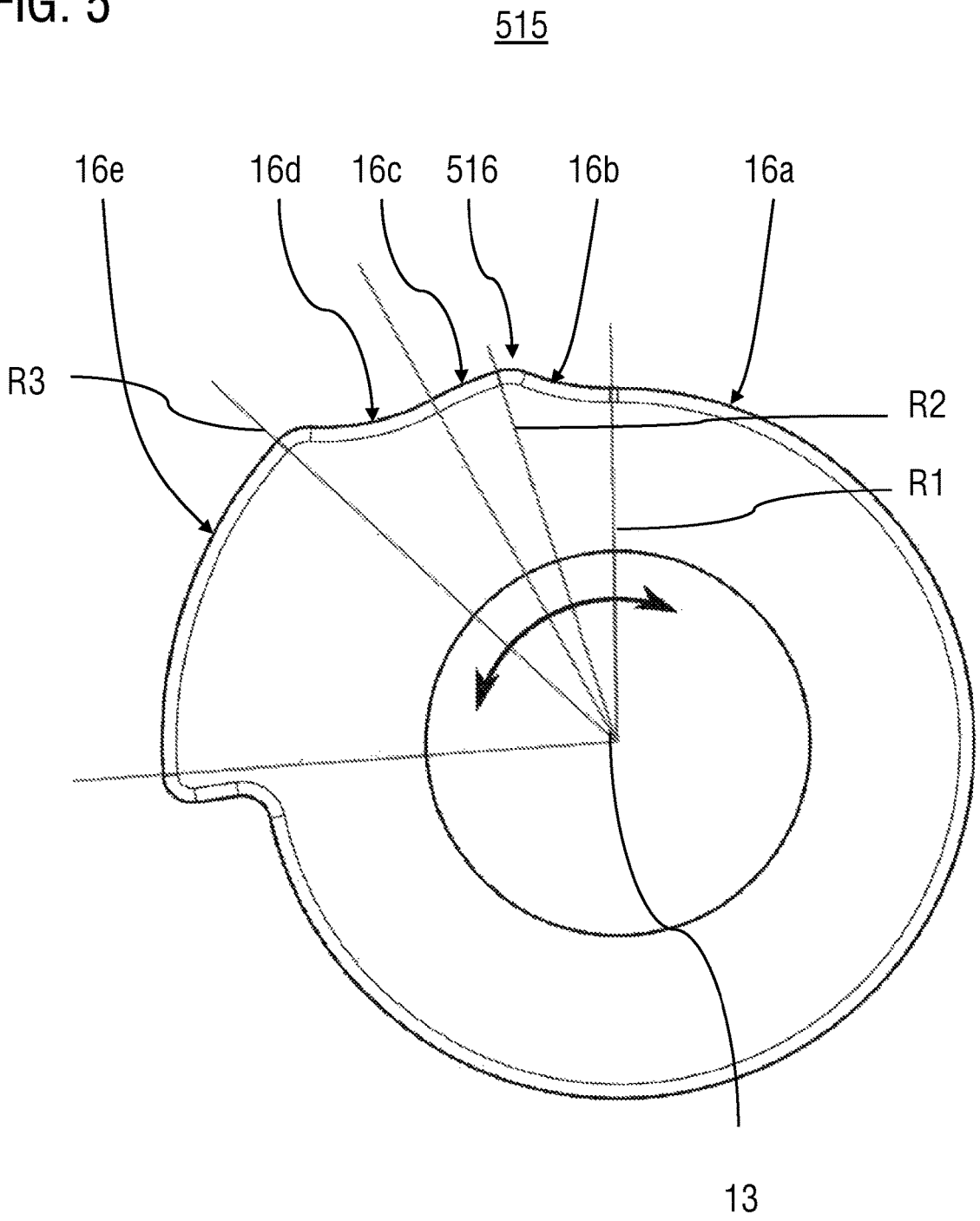
FIG. 5 shows a side view of a second lever of the transmission rocker lever according to a further embodiment of the present disclosure.

FIG. 5 shows a side view of the contour lever 515 of the transmission rocker lever 10 according to a further embodiment of the present disclosure. In this embodiment, the contour lever has a contour surface 516 with five different rolling regions 16*a*-16*e*. The first rolling region 16*a* again forms the base circle contour with constant radial spacing R1 to the axis of the axle 13. The adjoining second rolling region 16*b* in turn forms a ramp contour with an increasing radial spacing, which radial spacing has increased to the value R2 at the end of the second rolling region. The adjoining third rolling region 16*c* then in turn forms a region with a constant radial spacing R2. Said third rolling region 16*c* is then adjoined, in the rolling direction, by a fourth rolling region 16*d*, which in turn forms a ramp contour. At the end of the fourth rolling region 16*d*, the radial spacing has increased to the value R3. The fourth region is then adjoined by a fifth rolling region 16*e*, which in turn has a constant radial spacing. The rolling points on the fifth rolling region 16*e* have a constant radial spacing to the axis of the rocker lever axle of the transmission lever. The radial spacing R3 of the fifth rolling region 16*e* is greater than the radial spacing R2 of the third rolling region 16*c* and greater than the radial spacing R1 of the first rolling region 16*a*. In this design variant with five rolling regions, the third region 16*c* forms a middle position, in which the lifting valve is briefly, that is to say when the roller 26 rolls on the third region 16*c*, held open in an open position with a constant lift height which is smaller than the maximum lift height.

Figure 6:
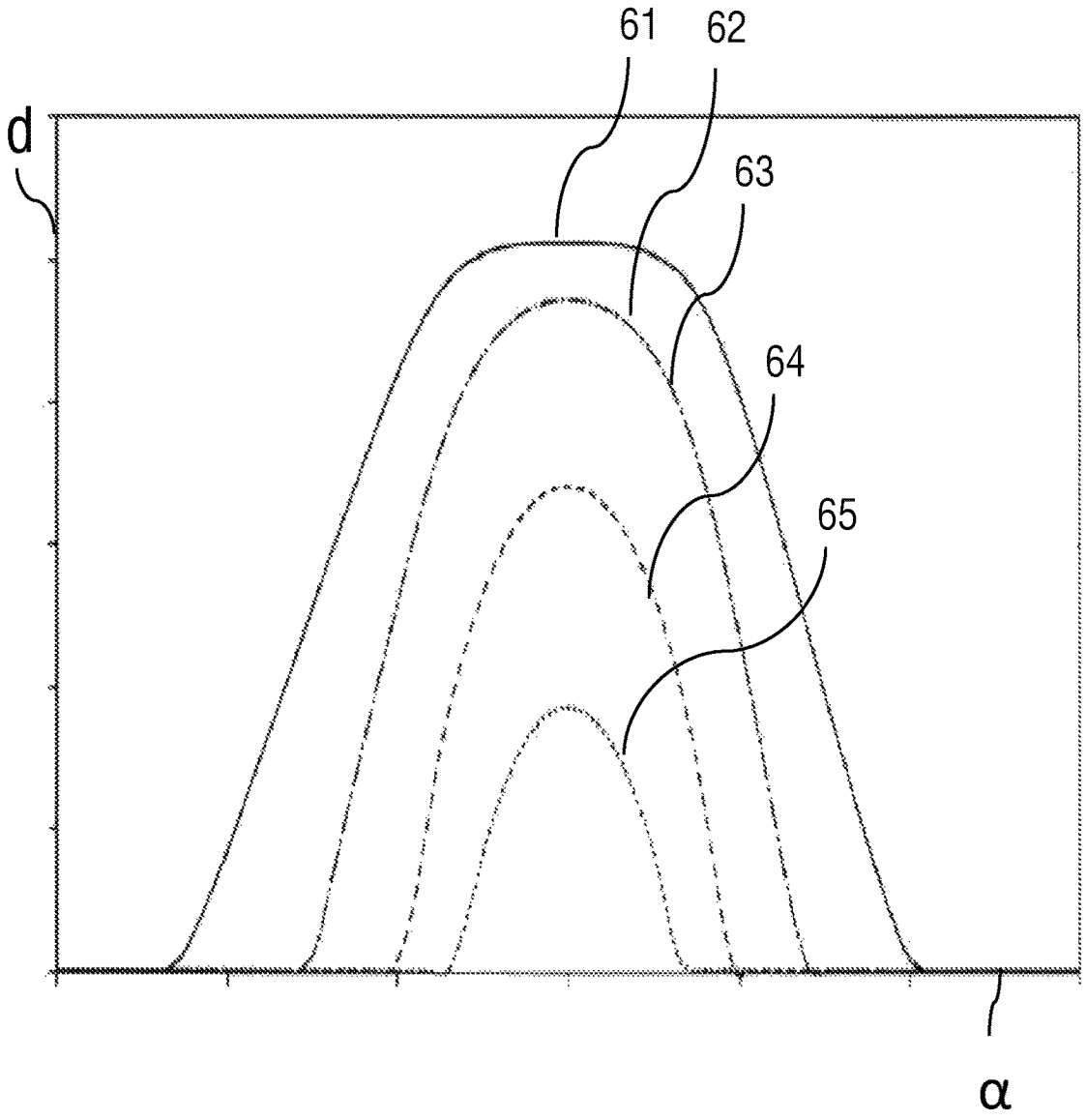
FIG. 6 shows an illustration of various settable lift curves of the lifting valve.

FIG. 6 illustrates different lift curves that can be set by way of the valve drive. The angle of rotation a of the camshaft 3 is plotted on the abscissa. The valve lift d is plotted on the ordinate. The curves 61 to 64 show four different settable valve lift profiles as a function of the angle of rotation of the camshaft. Each of the four curves 61 to 64 corresponds to a particular rotational position, set by way of the actuating device, of the second lever 15 relative to the first lever 14 of the transmission rocker lever 10. Here, the curve 61 corresponds to a set rotational position which generates the largest valve lift and the shortest valve closing times, whereas, by contrast, the curve 65 generates the smallest valve lift and the longest valve closing times.

Figure 7:
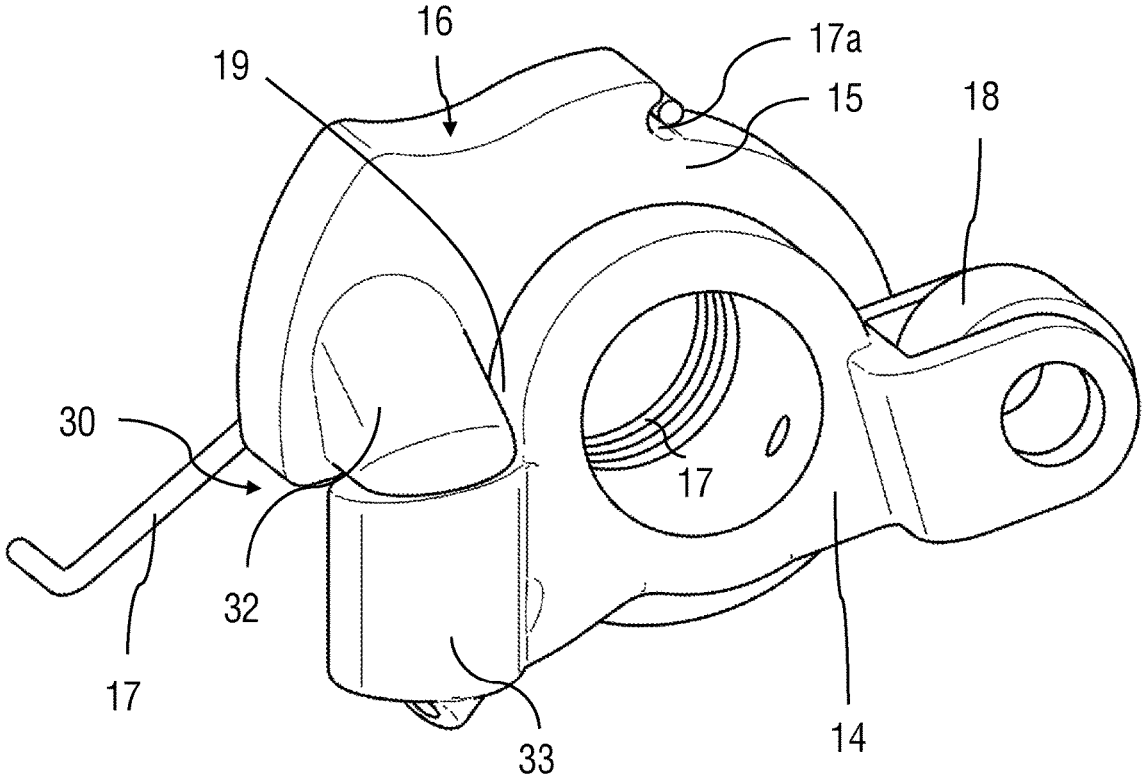
FIG. 7 shows a perspective illustration of the transmission rocker lever in a first switching state according to an embodiment of the present disclosure.
Figure 8:
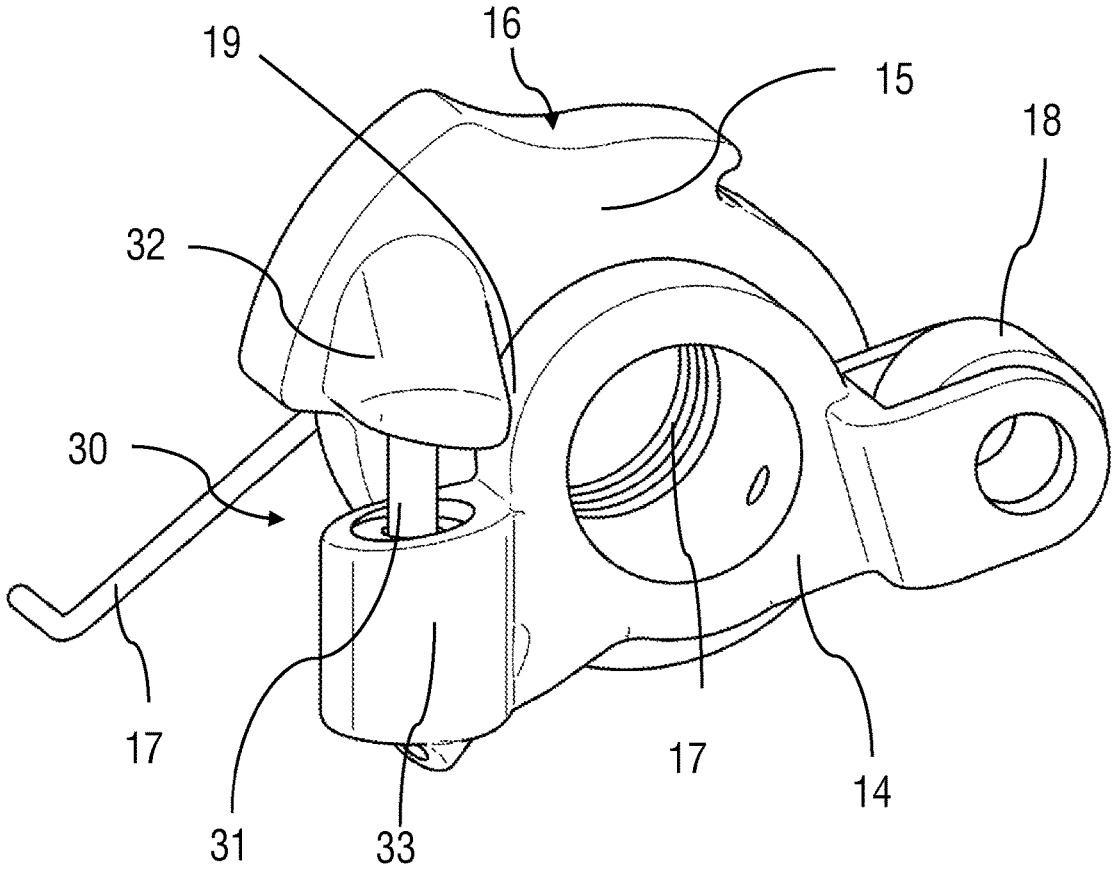
FIG. 8 shows the transmission rocker lever from FIG. 7 in a second switching state.

FIGS. 7 and 8 illustrate the mode of operation of the hydraulic actuating device. Here, FIG. 7 is a perspective illustration of the two-part construction of the transmission rocker lever 10 in a first switching state.

It has already been discussed above that the transmission rocker lever 10 has a two-part construction. Here, the transmission rocker lever 10 has a first lever (cam follower lever) 14, which is in engagement with the cam 2 of the camshaft 3, and a second lever (contour lever) 15, which has the contour surface 16 which is operatively connected to the roller 26 of the valve rocker lever 20.

The cam follower lever 14 and the contour lever 15 are coupled to one another in terms of movement by way of the driver 32, which presses against the abutment surface 19, in such a way that a rocking movement of the cam follower lever 14 generated by the cam 2 leads to a corresponding rocking movement of the contour lever 15 about the rocker lever axle 13 of the transmission rocker lever 10. Said movement coupling of cam follower lever 14 and contour lever 15 may also be realized not by way of the driver that is shown but by way of other positively locking or hydraulic connections, for example by way of an internal toothing, a pivoting motor principle, etc., and may be attached at a location other than that shown.

By way of a hydraulic actuating device 30, however, a rotational position of the contour lever 15 relative to the cam follower lever 14 can be varied in order to vary a rolling region of the roller 26 of the valve rocker lever 20 on the contour surface 16.

For this purpose, the hydraulic actuating device 30 comprises a hydraulically actuated pin 31, also referred to in this document as switching pin 31, which is fastened by way of one end to the cam follower lever 14 and which is arranged by way of another end on the contour lever 15.

As can be seen in FIGS. 7 and 8, the cam follower lever 14 has, for this purpose, a pin receptacle 33 for holding the switching pin 31, in which pin receptacle there is arranged a pressure chamber (not shown) which can be charged with a hydraulic liquid. The hydraulic lines for the supply to the pressure chamber and the control lines of the actuating device 30 are not illustrated. The other end of the switching pin is held in a receptacle on the contour lever 15, wherein the receptacle simultaneously forms the driver 32.

Upon activation of the actuating device, the pressure chamber is charged with hydraulic liquid, whereby the switching pin 31 is moved from the retracted state shown in FIG. 7 into the deployed state shown in FIG. 8.

As a result of the deployment of the switching pin 31, the contour lever 15 rotates clockwise into a different rotational position relative to the cam follower lever 14. As a result, the contour surface 16 likewise rotates clockwise. Thus, the rolling region for the roller 26 of the valve rocker lever 20 changes. Depending on the design of the actuating device 30, different deployment positions of the switching pin 31, and thus different rotational positions, can be set by controlling the pressure level in the pressure chamber.

The cam follower lever 15 is preloaded by way of a restoring spring 17 via a restoring spring abutment point 17*a*, such that the entire transmission rocker lever 10 is forced against the camshaft 3 by the spring force of the restoring spring.

Even though the present disclosure has been described with reference to particular exemplary embodiments, it is self-evident to a person skilled in the art that numerous changes may be made, and equivalents used as substitutes, without departing from the scope of the present disclosure. Furthermore, numerous modifications may be made without departing from the associated scope. Consequently, the present disclosure is not intended to be restricted to the exemplary embodiments disclosed, but rather is intended to encompass all exemplary embodiments which fall within the scope of the appended patent claims. In particular, the present disclosure also claims protection for the subject matter and the features of the subclaims independently of the claims to which reference is made.

LIST OF REFERENCE DESIGNATIONS

1 Variable valve drive
2 Cam
3 Camshaft
10 Transmission rocker lever
11 First end
12 Second end
13 Rocker lever axle of the transmission rocker lever
14 First lever or cam follower lever
15, 515 Second lever or contour lever
16, 516 Contour surface
16*a*, 16*b*, 16*c*, 16*d*, 16*e* Rolling regions
17 Restoring spring
17*a* Abutment point for restoring spring
18 Roller
19 Abutment surface
20 Valve rocker lever
21 First end or valve-side lever arm
22 Second end or camshaft-side lever arm
23 Rocker lever axle of the valve rocker lever
24 Receptacle
25 Hydraulic valve-clearance compensating element
26 Roller
27 Ring-shaped web
30 Actuating device
31 Hydraulic switching pin
32 Driver
33 Receptacle
61-65 Valve lift profile curve
a1 First rolling region
a2 Second rolling region
R1, R2, R3 Radial spacing of the rolling region to the axis of the rocker lever axle

The invention claimed is:

1. A variable valve drive for a lifting valve, which is periodically movable between a closed position and an open position indirectly by way of a cam of a camshaft, the variable valve drive comprising:

a switchable rocker lever arrangement for actuation of a lifting valve, having a transmission rocker lever and a valve rocker lever mounted so as to be pivotable on different rocker lever axles which are each parallel to a camshaft axis, wherein the valve rocker lever is in operative contact with the lifting valve at a first distal end and has a roller at a second distal end and pivots about a fulcrum located between the first and second distal ends, wherein the transmission rocker lever is in engagement with a cam of the camshaft at a first end and is operatively connected, by way of a contour surface to the roller of the valve rocker lever at a second end, in such a way that a rocking movement of the transmission rocker lever generates a rocking movement of the valve rocker lever, during which the roller of the valve rocker lever rolls on the contour surface, and wherein the contour surface (a) has a first rolling region which forms a base circle contour which generates no valve lift when the roller of the valve rocker lever rolls on the base circle contour, and (b) has a second rolling region which adjoins the first rolling region and which has a ramp contour; and an actuating device for the switching of the rocker lever arrangement, wherein the contour surface can be rotated about the rocker lever axle of the transmission rocker lever to generate a displacement of a rolling region of the roller of the valve rocker lever on the contour surface.

2. A variable valve drive according to claim 1, wherein the lifting valve is a charge-exchange valve of an internal combustion engine.

3. The variable valve drive according to claim 1, wherein the contour surface has a third rolling region which adjoins the second rolling region and which generates a valve position with maximum valve lift when the roller of the valve rocker lever rolls on the third rolling region.

4. The variable valve drive according to claim 1, wherein the transmission rocker lever has a first lever, which is in engagement with the cam of the camshaft, and a second lever, having the contour surface which is operatively connected to the roller of the valve rocker lever, wherein the first lever and the second lever are coupled to one another such that a rocking movement of the first lever generated by the cam leads to a corresponding rocking movement of the second lever about the rocker lever axle of the transmission rocker lever, and wherein, by way of the actuating device, a rotational position of the second lever relative to the first lever can be varied in order to vary a rolling region of the roller of the valve rocker lever on the contour surface.

5. The variable valve drive according to claim 4, wherein the actuating device is designed to vary a rotational position of the second lever relative to the first lever in continuously variable fashion.

6. The variable valve drive according to claim 4, wherein the actuating device is designed to vary a rotational position of the second lever relative to the first lever into two predetermined positions, such that switching is possible between two different valve lifts.

7. The variable valve drive according to claim 4, wherein the actuating device is designed as a hydraulic switching unit.

8. The variable valve drive according to claim 4, wherein the actuating device has a hydraulically actuated switching pin which, at one end, is fastened to the first lever and, at another end, is fastened to the second lever, and wherein a deployment of the hydraulically actuated switching pin varies a rotational position of the second lever relative to the first lever.

9. The variable valve drive according to claim 4, wherein the actuating device is designed as an electrical or mechanical actuating device.

10. The variable valve drive according to claim 4, wherein the first lever and the second lever are coupled to one another by way of a driver.

11. The variable valve drive according to claim 1, wherein the transmission rocker lever is preloaded by way of a restoring spring such that the transmission rocker lever is pushed against the camshaft.

12. The variable valve drive according to claim 4, wherein the first lever of the transmission rocker lever is preloaded by way of a restoring spring such that the transmission rocker lever is pushed against the camshaft.

13. The variable valve drive according to claim 3, wherein the contour surface has a fourth rolling region, which adjoins the third rolling region and which forms a ramp contour, and a fifth rolling region, which adjoins the fourth rolling region, and wherein the fifth rolling region has a constant radial spacing to the axis of the rocker lever axle of the transmission lever, which spacing is greater than the radial spacing of the third rolling region and the radial spacing of the first rolling region.

14. The variable valve drive according to claim 1, wherein the valve rocker lever, at its valve-side end, has a receptacle in which there is received a hydraulic valve-clearance compensating element or a screw with an elephant-foot configuration.

15. A motor vehicle having a variable valve drive for a lifting valve, which is periodically movable between a closed position and an open position indirectly by way of a cam of a camshaft, the variable valve drive comprising:

a switchable rocker lever arrangement for actuation of the lifting valve, having a transmission rocker lever and a valve rocker lever mounted so as to be pivotable on different rocker lever axles which are each parallel to camshaft axis, wherein the valve rocker lever, is in operative contact with the lifting valve at a first distal end and has a roller at a second distal end and pivots about a fulcrum located between the first and second distal ends, wherein the transmission rocker lever is in engagement with a cam of the camshaft at a first end and, is operatively connected, by way of a contour surface to the roller of the valve rocker lever at a second end, in such a way that a rocking movement of the transmission rocker lever generates a rocking movement of the valve rocker lever, during which the roller of the valve rocker lever rolls on the contour surface, and wherein the contour surface (a) has a first rolling region which forms a base circle contour which generates no valve lift when the roller of the valve rocker lever rolls on the base circle contour, and (b) has a second rolling region which adjoins the first rolling region and which has a ramp contour; and an actuating device for the switching of the rocker lever arrangement, wherein the contour surface can be rotated about the rocker lever axle of the transmission rocker lever to generate a displacement of a rolling region of the roller of the valve rocker lever on the contour surface.

16. The motor vehicle according to claim 15, wherein the motor vehicle is a utility vehicle.

* * * * *